US005271174A

United States Patent [19]

Bentley

[11] Patent Number: 5,271,174

[45] Date of Patent: Dec. 21, 1993

[54] COMBINATION WALL MOUNT/PORTABLE GUN LOCK ASSEMBLY

[76] Inventor: James K. Bentley, 29100 N. Lower Valley Rd., #46545-21, Tehachapi, Calif. 93561

[21] Appl. No.: 919,955

[22] Filed: Jul. 27, 1992

[51] Int. Cl.[5] ..... F41A 17/04

[52] U.S. Cl. ..... 42/70.11

[58] Field of Search ..... 42/70.01, 70.07, 70.11

[56] References Cited

U.S. PATENT DOCUMENTS

| | | | |
|---|---|---|---|
| 3,368,297 | 2/1968 | Lentz | 42/70.11 |
| 3,637,180 | 1/1972 | Parry | 42/70.07 |
| 4,499,681 | 2/1985 | Bako et al. | 42/70.07 |
| 5,048,211 | 9/1991 | Hepp | 42/70.11 |

*Primary Examiner*—Stephen C. Bentley

*Attorney, Agent, or Firm*—Charles C. Logan, II

[57] ABSTRACT

A combination wall mount/portable gun lock assembly having a U-shaped locking bar having a pair of laterally spaced leg members. One leg member is inserted into the open end of the gun barrel until it is in the firing chamber. The other leg member has a transversely extending leg portion formed on its end that passes through the trigger guard aperture when the locking bar is installed on the gun. A combination lock is then inserted over the free end of the transversely extending leg portion and pressed tightly against the trigger guard. The locking bar prevents the chambering of a round in the firing chamber of the gun. The U-shaped locking bar can be passed through transversely aligned apertures in the wall mount unit when it is desired to mount the gun on a wall.

6 Claims, 1 Drawing Sheet

COMBINATION WALL MOUNT/PORTABLE GUN LOCK ASSEMBLY

BACKGROUND OF THE INVENTION

The invention relates to a locking assembly and more specifically to a gun lock assembly.

A major concern of owners of guns is the fact, children may gain unauthorized access of guns with the consequence of someone being injured or killed. Another major concern is the guns may be stolen from a person's house.

Presently there are gun lock devices on the market that have not been entirely satisfactory. Some of these lock into the trigger guard behind the trigger thereby preventing the trigger being pulled. Often times this device can be pried apart and removed. Other devices are on the market that allow the weapon to be secured to a wall structure. Gun cabinets that can be locked are often mounted on a wall and many of them have glass pane doors that can be broken and provide access to the guns.

It is an object of the invention to provide a novel combination wall mount/portable gun lock assembly that can be easily installed and quickly removed when the person has the key or combination to the lock.

It is another object of the invention to provide a novel combination wall mount/portable gun lock assembly that is economical to manufacture and market.

It is a further object of the invention to provide a novel combination wall mount/portable gun lock assembly that can be made in different models that will work with handguns and rifles.

SUMMARY OF THE INVENTION

The novel gun lock assembly has as its major component a U-shaped locking bar having a pair of laterally spaced legs. The locking bar is preferably made from an elongated rod of steel or other material that cannot be easily cut. One leg of the locking bar is inserted into the open end of a gun barrel until its end seats in the firing chamber of the gun. The other leg of the locking bar has a transversely extending leg portion formed at its end and this aligns with the aperture of the trigger guard when the other leg member is in the firing chamber. The transversely extending leg portion has a plurality of longitudinally spaced notches thereon and it is detachably received in the recess of the rear wall of a combination lock. The combination lock would have conventional structure with a latch pin that is spring loaded to drive it into locking position in one of the notches in the transversely extending leg portion. The combination lock has a layer of compressible material, such as rubber, attached to its rear wall that is compressed snugly against the trigger guard. The layer of compressible material will not mar the finish of the gun.

If there is a round of ammunition in the firing chamber the one leg of the locking bar cannot be fully inserted into the barrel far enough for the transversely extending leg portion to align with the trigger guard aperture. This quickly tells a person trying to install the gun lock assembly that there is a round of ammunition in the firing chamber.

The length of the leg members can be relatively short for a gun lock assembly to be used only with a handgun. The gun lock assembly would have longer leg members if it were to be used with a rifle. It should be noted, the model that will work with a rifle can also be used on a handgun. The combination lock or padlock that would be used with the gun lock assembly would be made of heat tempered steel.

If it is desired to secure the gun to the wall of a room, the wall mount unit would be used. It has a base plate portion that is attached to the bottom end of a tubular neck portion. An aperture in the base plate portion communicates with the interior of the neck portion so that a hex bolt can be screwed therethrough and into a rigid wall structure. A plug is then inserted into the tubular neck portion to prevent access to the head of the hex bolt. Preparatory to mounting a gun on the wall mount unit, one end of the U-shaped locking bar is inserted through transversely aligned apertures in the neck portion of the wall mount unit. The end of one of the leg members is inserted into the barrel of the gun while the transversely extending leg portion is inserted through the trigger guard of the gun. Next the combination lock is secured on the free end of the transversely extending leg portion.

The novel gun lock assembly can thus be mounted on a wall by using all of its components and locking it with the combination lock. If a person wishes to carry the gun with him, he merely takes the U-shaped locking bar and the combination lock with him. Thus, only a single combination lock is required and it has a dual purpose to work in combination with the wall mount unit or when the gun is being carried around by a person in his car or otherwise.

DESCRIPTION OF THE PREFERRED EMBODIMENT

Figure 2:
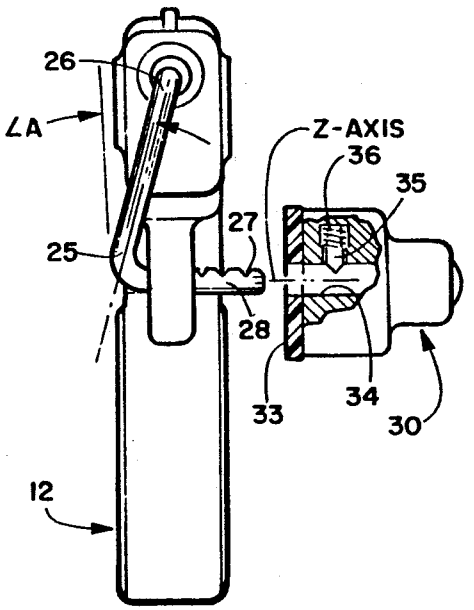
FIG. 2 is a front elevation view of the handgun with the combination lock shown in exploded view.
Figure 1:
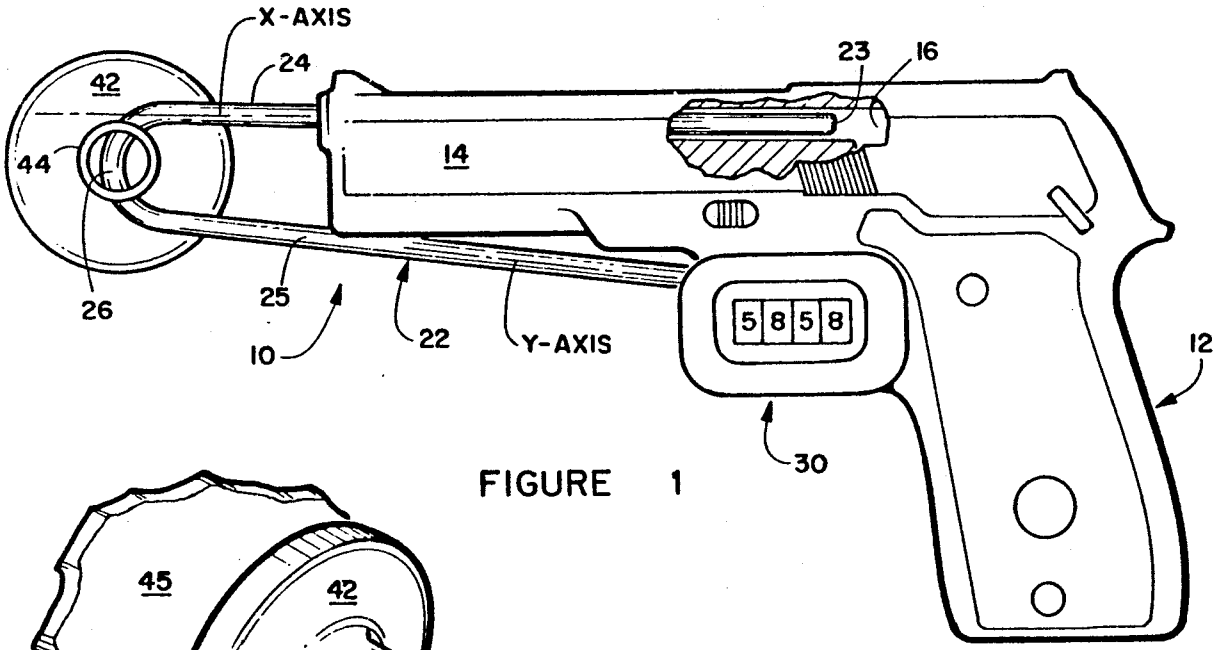
FIG. 1 is a side elevation view of a handgun showing the combination wall mount/travel gun lock assembly installed thereon.

The novel combination wall mount/portable lock assembly will now be described by referring to FIGS. 1–3 of the drawing. The gun lock assembly is generally designated numeral 10.

A handgun 12, in this case an automatic, has a barrel 14 that extends rearwardly to a firing chamber 16. Gun 10 has a trigger guard 18 and a trigger (not shown).

U-shaped locking bar 22 has leg members 24 and 25 that are connected together by connecting member 26. A transversely extending leg portion 28 is formed on the end of leg member 25. In its installed position, the end 23 of leg member 24 is at the back of firing chamber 16. Leg member 24 has an x-axis and leg member 25 has a y-axis. These two axes are not parallel to each other but are oriented to each other a predetermined angle. Transversely extending leg portion 28 has a z-axis that is substantially perpendicular to the end of leg member 25.

Leg member 25 is oriented at an angle A with respect to a perpendicular axis passing vertically through the gun. This is shown in FIG. 2 in the front elevation view that has the gun lock assembly in its installed position. Combination lock 30 has a plurality of tumblers in its front raised portion that are internally connected to conventional structure. The rear wall of combination lock 30 has a layer of compressible material 33 having a bore hole 34 therein. Latch pin 35 under tension from spring 36 will engage one of the notches 37 on transversely extending leg portion 28.

Figure 3:
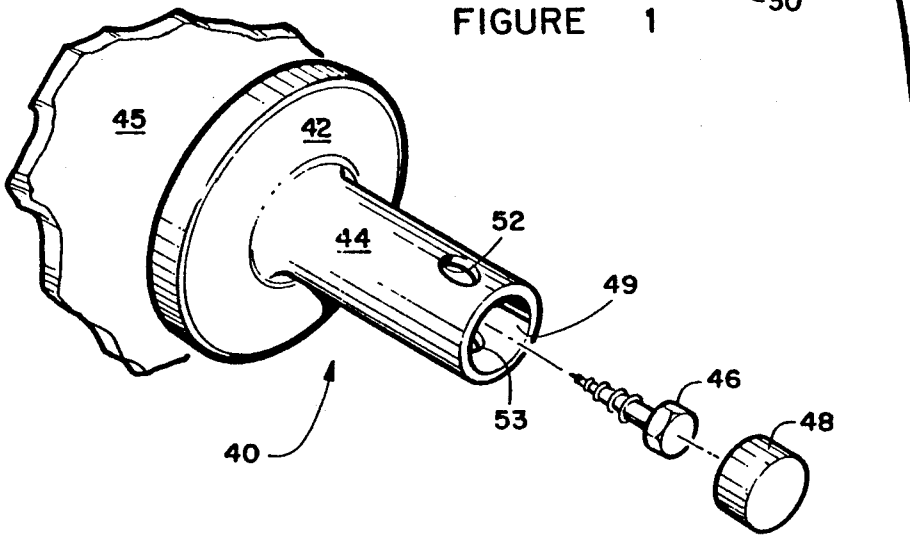
FIG. 3 is an exploded perspective view of the wall mount unit.

Wall mount unit 40 is illustrated in FIG. 3. It has a base plate portion 42 having an aperture 43 (not shown) through which a hex bolt 44 may be screwed into a stud in wall 45. A plug 48 is inserted into the bore 49 of neck portion 44 to prevent access to the head of the hex screw once it has been installed. U-shaped locking bar 22 is inserted through aligned apertures 52 and 53 and then securely locked to gun 12 by combination lock 30.

What is claimed is:

1. A gun lock assembly comprising:

a U-shaped locking bar having a pair of laterally spaced first and second leg members and a connecting member, said first leg member being designed so that it can be inserted into the open end of a gun barrel, said second leg member having an end remote from said connecting member, a transversely extending leg portion is connected to the remote end of said second leg member and it is removably passed through the interior of the trigger guard of a gun;

means for locking said transversely extending leg portion to the trigger guard of a gun to prevent the gun lock assembly from being removed from the barrel of a gun; and a wall mount unit having a base plate portion and a tubular neck portion, said neck portion having a predetermined inner diameter that receives a plug, an aperture in said base plate portion that communicates with the interior of said tubular neck portion, a pair of transversely oriented apertures in said tubular sleeve that can receive one of the legs of said U-shaped locking bar.

2. A gun lock assembly as recited in claim 1 wherein said U-shaped locking bar is formed from a steel rod that has been bent into a predetermined shape.

3. A gun lock assembly as recited in claim 1 wherein said first leg member is substantially the same length as said second leg member.

4. A gun lock assembly as recited in claim 1 wherein said means for locking said transversely extending leg portion to the trigger guard comprises a combination lock having a bore hole in its rear wall that detachably receives said leg portion.

5. A gun lock assembly as recited in claim 4 further comprising a layer of compressible material on the rear wall of said combination lock.

6. A gun lock assembly as recited in claim 1 in combination with a gun.

* * * * *